United States Patent [19]

Kelch et al.

[11] 3,950,633

[45] Apr. 13, 1976

[54] DAMPED TRANSFER ARRANGEMENT FOR A COUNTER

[75] Inventors: Heinz Kelch, Buchenberg; Helmut Müeller, Sankt Georgen, both of Germany

[73] Assignee: Kienzle Apparate GmbH, Villingen, Germany

[22] Filed: May 13, 1974

[21] Appl. No.: 469,742

Related U.S. Application Data

[63] Continuation of Ser. No. 338,551, March 6, 1973, Pat. No. 3,836,072.

[30] Foreign Application Priority Data

Mar. 9, 1972 Germany ..... 2211392

[52] U.S. Cl. ..... 235/133 R; 235/95 R; 235/144 R

[51] Int. Cl.[2] ..... G06C 7/10

[58] Field of Search ..... 74/460–461; 235/94 R, 95 R, 133 R

[56] References Cited

UNITED STATES PATENTS

| | | | |
|---|---|---|---|
| 820,789 | 5/1906 | Hutchins | 74/461 |
| 1,460,661 | 7/1973 | Coninck | 74/461 |
| 3,257,860 | 6/1966 | Runde | 74/461 |
| 3,304,795 | 2/1967 | Rouverol | 74/461 |
| 3,337,129 | 8/1967 | Johnson | 235/95 R |
| 3,496,791 | 2/1970 | Gabriel | 74/461 |
| 3,636,792 | 1/1972 | Vigh | 74/461 |
| 3,730,009 | 5/1973 | Mead | 74/243 R |

*Primary Examiner*—L. T. Hix
*Assistant Examiner*—Vit W. Miska
*Attorney, Agent, or Firm*—Michael J. Striker

[57] ABSTRACT

Two successive ordinal toothed counter wheels are connected by toothed transfer means to make a tens-transfer once during each revolution of the counter wheel of the lower order. The teeth of the counter wheels and of the transfer means are cut out and hollowed so that the teeth are resilient and dampen impacts thereon during the transfer operation.

7 Claims, 6 Drawing Figures

DAMPED TRANSFER ARRANGEMENT FOR A COUNTER

This is a continuation of application Ser. No. 338,551 filed on Mar. 6, 1973, now U.S. Pat. No. 3,836,072.

BACKGROUND OF THE INVENTION

The present invention relates to a damping arrangement effective during the transfer of intermittent movements of counter wheels in counters, particularly for the tens-transfer in rapidly rotating counters.

In gas stations, where gasoline is automatically metered, counters including a plurality of ordinal counter wheels are used, which are connected with each other by tens-transfer means.

It is necessary that the counter wheels have large indicating wheels which require that the counter wheels have certain minimum size, and consequently a certain minimum mass which cannot be further reduced without impairing the legibility of the indication. Particularly, with the counter wheel of the lowest order, which is the driven input counter wheel and indicates the smallest units, difficulties occur because a minimum size and mass cannot be further reduced, while on the other hand, for economic reasons, the greatest possible amount of flow of liquid through apparatus is to be registered. Particularly the number wheels of the lowest order, and during the tens-transfer also the number wheels of the higher orders, must be driven at very high rotary speeds, and must be able to withstand the high loads resulting therefrom.

In known counters, the input counter roller is continuously rotated by means of a gear secured to the respective counter wheel. During a transfer operation by which a unit has to be transferred to the next higher order and if necessary also to further higher orders, a transfer lug, which is fixedly connected with the input counter wheel, strikes while rotating at high speed, the toothed flanks of a tens-transfer gear which turns about an axis parallel to the axis of the counter wheels. The tens-transfer gear also meshes with the gear of the counter wheel of the next higher order and cooperates with a cam disc which locks the transfer gear, but releases the transfer gear for angular movement when a unit is to be transferred.

Counters of this type have the great disadvantage that the transfer lug strikes the respective tooth of the transfer gear, which is at first at a standstill, with a very hard impact. In the same moment, acceleration of a mass is required, which depends on the number of counter wheels to be shifted, and the accelerated masses must be rapidly decelerated until the transfer gear is again in the normal position. The occurring force peaks must be sustained without damping, and even if high quality material is used, disturbances and damage frequently occur, because the material cannot resist the high stresses. Furthermore, the load peaks of the impacts have also an effect on the drive means of the counter, and may detrimentally influence the precision of the values metered by the counter, and the exact transfer of such values to the indicator.

Another construction of the prior art provides a transfer means which consists of two coupling elements connected by a torsion spring. To assure the complete transfer operation, additional connecting means are required, and the device consists of a great number of parts so that manufacture and maintenance is expensive. The resilient coupling element has no effect during a rapid deceleration after completion of the tens-transfer.

SUMMARY OF THE INVENTION

It is one object of the invention to provide a resilient transmission of the intermittent movements of counter wheels in counters, which overcomes the disadvantages of the prior art.

Another object of the invention is to dampen impacts of cooperating teeth in the tens-transfer device of an ordinal counter.

In accordance with the invention, the teeth of the counter wheels, and of the tens-transfer device are formed with cutouts so that the teeth are resilient and dampen impacts thereon. Preferably, also the peripheral rim of a transfer wheel is formed with a cutout and rendered resilient for damping the impact of a tooth of a tens-transfer gear.

In order to make resilient the zones where the peak forces prevail, and to transform impact energy into the deformation of an elastic zone, in the preferred embodiment of the invention, the teeth have cutouts equidistant to the tooth flanks so that resilient flank walls are formed between the addendum circle and the dedendum circle of the tooth. For the same reason, the resilient flank walls axially project from a supporting disc, and may be located on one side or on both sides of the disc. In order to render the damping particularly effective, all force-transmitting elements of the apparatus are formed with cutouts and made resilient.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
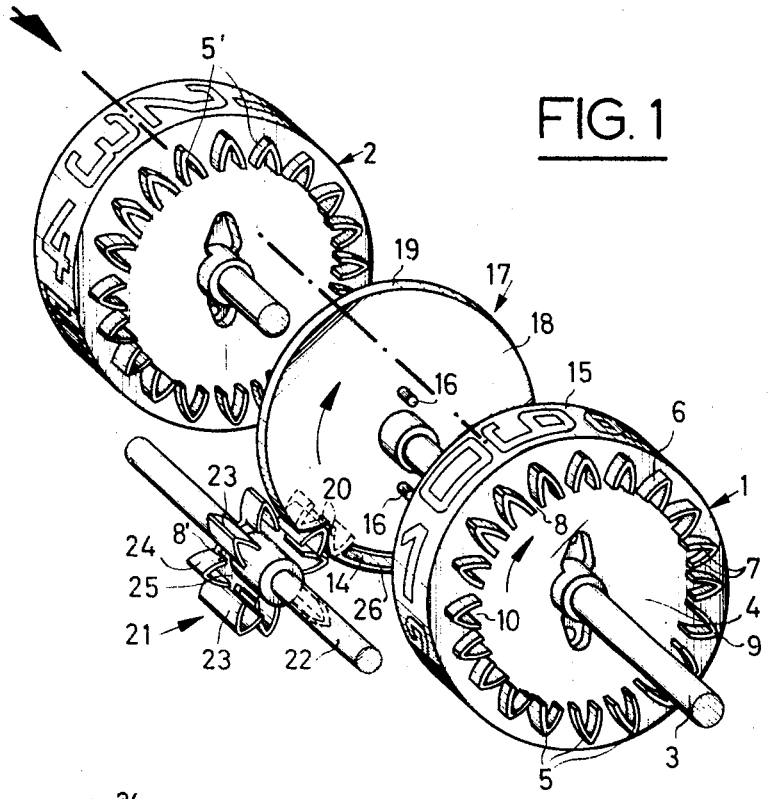
FIG. 1 is a fragmentary exploded perspective view schematically illustrating two successive ordinal counter wheels, and tens-transfer means therebetween.

The portion of a counter shown in FIG. 1 includes counter wheels 1 and 2 correlated with successive decimal orders, and being mounted for free rotation on a shaft 3 supported by lateral walls, not shown. It is assumed that counter wheel 1 is the counter wheel of the lowest decimal order, and serves as input counter wheel, driven from a metering device through a gear, not shown, cooperating with the circular row of counter teeth 9. The teeth 9 axially project from a disc 4, and have cutouts 10 parallel to the flanks 6 of the teeth 9 so that teeth 9 only consist of resilient flank walls 7. The flanks 6 have preferably involute shape, while the cutouts 10 within a tooth body 9 can have different shapes, while the root portion 8 may be omitted.

As shown in FIG. 1, the cutouts 10 in the counter teeth 9 of the circular row 5 are shaped so that the inner surfaces of the flank walls 7 are equidistant from the flanks 6, and the flank walls have a constant thickness.

An outer cylindrical surface 15 is formed on 4, and is provided with ten indicia, for example the digits 0 to 9.

The counter wheels of higher orders are stepwise shifted, only counter wheel 2 of the second decimal order being shown, and during one full revolution of a counter wheel, the counter wheel of the next higher order is turned one angular step corresponding to the angular distance between two indicia on the cylindrical surface 15.

Figure 5:
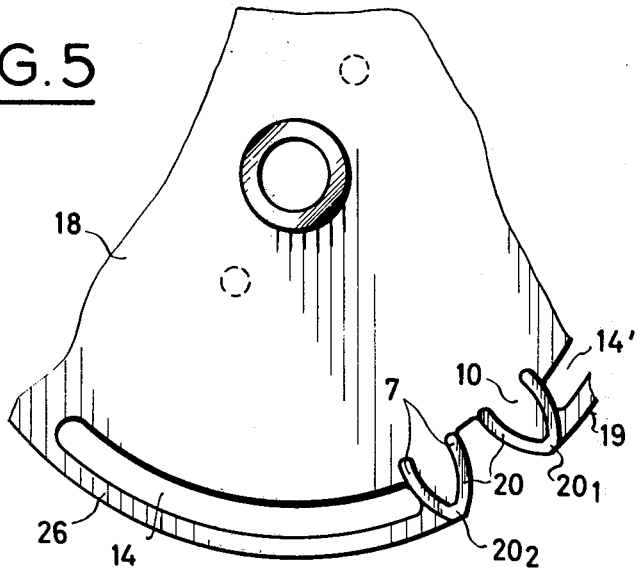
FIG. 5 is a fragmentary side view on an enlarged scale, illustrating a preferred embodiment of a transfer wheel with transfer lugs or teeth for shifting the transfer gear.

The tens-transfer is accomplished by a transfer device which includes a transfer wheel 17 which has a circular disc 18 connected by pins 16 with the first counter wheel 1 for rotation. As also shown in FIG. 5, the disc 18 carries two axially projecting teeth or lugs $20_1$ and $20_2$ which have the above-described cutouts 10 to form flank walls 7 of uniform thickness and elasticity. The disc 18 of the transfer wheel 17 has a circular peripheral rim 19 under which part-circular cutouts 14 and 14' are provided adjacent the transfer teeth $20_1$ and $20_2$ so that resilient part-circular bar-shaped portions 26 are formed on which parts of the peripheral rim 19 are located. The circumferential length of the cutouts 14 may correspond to two angular distances between counter teeth 5.

The transfer gear 21 connects the first counter wheel 1 and transfer wheel 17 with the circular row 5' of counter teeth of the second counter wheel 2. Transfer gear 21 has alternating teeth 23 and 24, the teeth 23 being longer in axial direction than the teeth 24.

Long teeth 23 of transfer gear 21 extend along the peripheral rim 19 and the respective transfer tooth 20 of the transfer wheel 17 secured to the first counter wheel 1. At the same time, the respective long tooth 23 meshes with the counter teeth of the circular row 5' of counter wheel 2 associated with the next higher decimal order. Due to the fact that a long tooth 23 cooperates with the peripheral rim 19, sliding thereon during turning of the first counter wheel 1, the respective long tooth 23 prevents a turning movement of the transfer gear 21, and of the counter wheel 2 during the turning of counter wheel 1 for the first nine angular steps.

When the first counter wheel 1 turns the tenth angular step and completes one revolution, the first transfer tooth $20_1$ strikes the following short tooth 24 of the transfer gear 21 which is at a standstill, and causes turning movement of transfer gear 21 and of the meshing counter wheel 2 directly from a condition of rest to full rotary speed. After passing through the tens-transfer operation, it is necessary to rapidly decelerate all masses accelerated by the impact on the short tooth 24, including the transfer gear 21, the counter wheel 2, and following counter wheels and tens-transfer devices of higher orders, not shown, if they are in the required angular position. For decelerating the masses, the next following long tooth 23 engages the peripheral rim 19 of the disc 18, and blocks further movement of the transfer gear 21, and of the counter wheels of higher order. For damping this hard impact, and the effect of the impact on the respective parts, the transfer teeth 23, 24 of the transfer gear 21 freely project in axial direction from disc 25, and are cut out to form flank walls 7' of uniform selected thickness, while the root 8' which usually connects the flanks 6, may be omitted. As noted above, the transfer teeth $20_1$ and $20_2$ are constructed in the same manner to be resilient. The curved cutouts 14 form resilient portions 26 which are part of the peripheral rim 19, and are engaged by the next following long tooth 23. The curved portion 26 is elastic in radial direction, comparable to a convex leaf spring, and therefore exerts a damping influence on peak loads.

Only one cutout 14 and transfer lug $20_1$ or $20_2$ is required if the counter wheels rotate only in one direction of rotation, but when also negative operations are required, two transfer teeth $20_1$ and $20_2$ and two elastic rim portions 26 are required.

When the first counter wheel 1 is continuously driven as input counter wheel by gears, not shown, meshing with the circular row 5 of teeth 9, the transfer gear 21 is shifted by the respective transfer tooth $20_1$ or $20_2$, and shifts the second counter wheel 2 one angular step to the next counting position.

Figure 2:
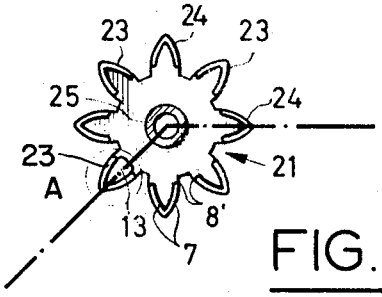
FIG. 2 is a side view illustrating a transfer gear according to the invention.
Figure 3:
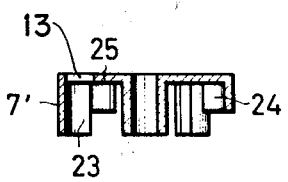
FIG. 3 is an axial sectional view illustrating a transfer gear with a supporting disc, and axially projecting transfer teeth on one side.
Figure 4:
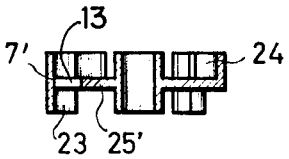
FIG. 4 is an axial sectional view illustrating a modified transfer gear having a disc and transfer teeth projecting in opposite axial directions from the disc.

FIGS. 2, 3 and 4 shows constructions of the transfer gear 21. The teeth 23, 24 are composed of two resilient curved flank walls 7 or 7' which resiliently yield when the flanks are engaged, but also yield resiliently in circumferential direction in relation to the supporting disc 25. The flank walls 7' project in axial direction from the disc 25 and have one end secured to the disc 25, as shown in FIG. 3. The root portion 8' may be omitted to improve the elasticity in circumferential direction.

In the modification shown in FIG. 4, the disc 25' is arranged at the end of the short tooth 24, and the long teeth 23 project in opposite axial directions from the disc 25'. As shown in FIG. 2, in the region A, the disc 25, which is normally gear-shaped and has peripheral radial tooth shaped projections, is cut out at 13 and the radial projections of the disc 25 have the same configuration as the respective tooth, so that the flank walls of each tooth are connected with the disc 25 by parts having the same width as the flank walls 7.

Figure 6:
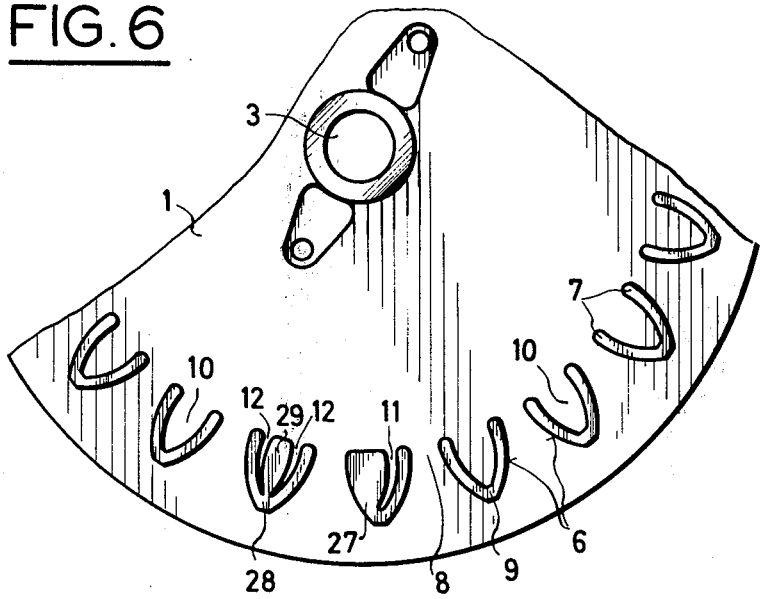
FIG. 6 is a fragementary side view illustrating a counter wheel provided with counter teeth according to several modifications of the invention.

Further modifications of the teeth according to the present invention are shown in FIG. 6. A tooth 27 is shown, which has a narrow cutout 11 so that only one narrow flank wall is formed. A tooth shaped as tooth 27 is very strong and suitable for impact damping transmission of very high turning moments in one direction. If the transfer of turning movements is to take place in both directions of rotation, the construction shown for tooth 28 is advantageous in which two narrow cutouts 12 form flank walls, while a core portion 29 remains which supports particularly the tip of the tooth 28.

The parts described above to be resilient by the novel constructions of the invention, are preferably made of a material which has suitable elasticity and resilience, and can be easily formed to the desired shape of the teeth.

A transfer gear 21 and a transfer wheel 17, as described above, are also used between the counter wheels of the higher orders. All transfer wheels 21 can be mounted for rotation on a shaft 22 parallel to counter shaft 3. When simultaneous tens-transfer between several pairs of counter wheels take place, the tenth transfer means according to the invention dampen the peak forces occurring during simultaneous tens-transfer in several orders since the energy is used for deforming the elastic parts.

By carefully selecting the dimensions for the teeth according to the invention, together with the use of a suitable elastic material, the disadvantages of known counter damping apparatus are overcome. Particularly, the present invention has the result to dampen simultaneously occurring tens-transfers by constructing all parts which engage each other of an elastic material.

Breakage is avoided, the transfer is quiet, and wear is reduced so that the life span of an arrangement according to the present invention is increased as compared with the prior art. No forces are transmitted to the metering device for a liquid from which the counter is driven.

The apparatus of the invention has substantially the same space requirements as known counter arrangements, and can be used with conventional metering apparatus.

It will be understood that each of the elements described above, or two or more together, may also find a useful application in other types of damping transfer arrangements for counters differing from the type described above.

While the invention has been illustrated and described as embodied in a damped tens-transfer arrangement including hollow resilient teeth for damping impacts during a tens transfer, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. Damped transfer arrangement for a counter comprising at least first and second ordinal counter wheels having first and second counter teeth, respectively; a transfer wheel secured to said first counter wheel and including a peripheral rim having a first transfer tooth;

and a transfer gear of deformable thermoplastic material and having second transfer teeth meshing with said second counter teeth and having a locked position in which one second transfer tooth slides on said peripheral rim for locking said transfer wheel and second counter wheel, another second transfer tooth being engaged with an impact by said first transfer tooth once during each revolution of said first counter wheel so that said transfer gear is angularly displaced for turning said second counter wheel, said first and second counter wheels and said transfer gear each include a disc, and said first and second counter teeth and said transfer teeth axially project from the respective disc and are formed with cutouts extending from the radially inner end of each tooth into the latter short of the radially outer end thereof so as to provide in each cutout tooth axially projecting, resilient, in tangential direction yieldably flank walls connected to each other only at the addendum circle and having free ends at the dedendum circle to dampen the impact.

2. Transfer arrangement as claimed in claim 1, wherein said cutouts taper toward said disc.

3. Transfer arrangement as claimed in claim 1, wherein said first and second counter teeth, and said first and second transfer teeth are made of a thermoplastic material having a predetermined resiliency.

4. Transfer arrangement as claimed in claim 1, wherein said cutout in narrow and extends only adjacent and along one of the flanks of the respective tooth and ends short of the tip of the latter so that the resilient flank wall formed by said cutout remains connected at the tip of tooth to the remainder thereof.

5. Transfer arrangement as claimed in claim 1, wherein two narrow cutouts respectively extending along and adjacent opposite flanks of the respective tooth are provided, said cutout ending short of the tip of the respective tooth and forming between themselves a core portion and between each cutout and the respective flank resilient flank walls connected at the tip of the tooth to said core portion.

6. Transfer arrangement as claimed in claim 1, wherein the cutout in each of the cutout teeth is equidistant from the flanks of said teeth so that resilient flank walls of uniform thickness are formed between the addendum circle and the dedendum circle of each tooth.

7. Transfer arrangement as claimed in claim 5, wherein said cutouts taper toward said tip of the tooth.

* * * * *